US007591115B2

(12) United States Patent
Morris

(10) Patent No.: US 7,591,115 B2
(45) Date of Patent: Sep. 22, 2009

(54) ROOF TILE SUPPORT ARRANGEMENT

(76) Inventor: Richard J. Morris, A29 Princess Highway, Berry, New South Wales, 2535 (AU)

( * ) Notice: Subject to any disclaimer, the term of this patent is extended or adjusted under 35 U.S.C. 154(b) by 494 days.

(21) Appl. No.: 11/045,723

(22) Filed: Jan. 27, 2005

(65) Prior Publication Data

US 2005/0183366 A1 Aug. 25, 2005

Related U.S. Application Data

(63) Continuation-in-part of application No. 10/366,930, filed on Feb. 14, 2003, now abandoned.

(51) Int. Cl.
*E04D 1/34* (2006.01)

(52) U.S. Cl. ..... 52/546; 52/550; 52/545; 52/549; 52/552; 52/489.1

(58) Field of Classification Search ..... 52/518, 52/520, 539, 546, 551, 478, 545, 549, 550, 52/552, 489.1, 547, 474, 475.1, 479, 477
See application file for complete search history.

(56) References Cited

U.S. PATENT DOCUMENTS

| | | | | | |
|---|---|---|---|---|---|
| 476,381 | A | * | 6/1892 | Hawthorne | 52/276 |
| 2,140,691 | A | * | 12/1938 | Crump | 52/96 |
| 2,149,818 | A | * | 3/1939 | North | 52/409 |
| 3,380,214 | A | * | 4/1968 | Stevens | 52/478 |
| 3,703,795 | A | * | 11/1972 | Mattes | 52/521 |
| 4,499,700 | A | | 2/1985 | Gustafsson | |
| 4,698,942 | A | * | 10/1987 | Swartz | 52/99 |
| 4,803,818 | A | * | 2/1989 | Funaki | 52/520 |
| 4,958,471 | A | * | 9/1990 | Waddington | 52/546 |
| 5,283,998 | A | * | 2/1994 | Jong | 52/515 |
| 5,392,579 | A | * | 2/1995 | Champagne | 52/520 |
| 5,537,792 | A | * | 7/1996 | Moliere | 52/531 |
| 5,577,360 | A | * | 11/1996 | Gibbs | 52/518 |
| 5,617,690 | A | * | 4/1997 | Gibbs | 52/518 |
| 5,642,596 | A | * | 7/1997 | Waddington | 52/546 |
| 5,737,881 | A | * | 4/1998 | Stocksieker | 52/90.1 |

(Continued)

FOREIGN PATENT DOCUMENTS

| | | | |
|---|---|---|---|
| JP | 02248563 | A | 10/1990 |

(Continued)

*Primary Examiner*—Richard E Chilcot, Jr.
*Assistant Examiner*—Chi Q Nguyen
(74) *Attorney, Agent, or Firm*—Abelman, Frayne & Schwab

(57) ABSTRACT

A tile support arrangement comprising interlocking panels adapted to support thereon a plurality of tiles, battens which support thereon the interlocking panels, the battens secured to load bearing frame members of an inclined roof or a wall of a building, wherein each batten includes an upright portion which supports the interlocking panels in spaced relationship to the frame members and wherein the securing of the battens to the load bearing frame members comprises a plurality of elongated beams having first longitudinal axes and which are secured in end to end relationship upon each load bearing frame member. Each frame member having a second longitudinal axis, the relationship being such that there is alignment of the first and second longitudinal axes, wherein for each load bearing frame member, a lower portion of a batten is sandwiched between facing surfaces of opposing ends of adjacent elongated beams and is secured to at least one of the opposing ends.

19 Claims, 6 Drawing Sheets

U.S. PATENT DOCUMENTS 5,791,112 A * 8/1998 Plum ..... 52/551
5,794,396 A * 8/1998 Gibbs ..... 52/518
6,052,961 A * 4/2000 Gibbs ..... 52/518
6,296,603 B1 * 10/2001 Turnlund et al. ..... 600/3
6,883,290 B2 * 4/2005 Dinwoodie ..... 52/748.1
6,948,288 B1 * 9/2005 Smith ..... 52/409
7,178,295 B2 * 2/2007 Dinwoodie ..... 52/173.3
2002/0174618 A1 * 11/2002 Carroll ..... 52/520
2003/0014936 A1 * 1/2003 Watanabe ..... 52/518
2003/0037503 A1 * 2/2003 Heinemann ..... 52/536
2003/0182888 A1 * 10/2003 Desbois et al. ..... 52/551

FOREIGN PATENT DOCUMENTS

JP 02248563 A * 10/1990

* cited by examiner

ROOF TILE SUPPORT ARRANGEMENT

CROSS REFERENCE TO RELATED APPLICATION

This application is a continuation-in-part of U.S. patent application Ser. No. 10/366,930, filed 14 Feb. 2003 now abandoned, the disclosure of which is incorporated herein by reference and made a part of this disclosure.

TECHNICAL FIELD

The present invention relates to a tile support arrangement and, in particular, to a tile support arrangement for supporting flat plate tiles on an inclined roof or against the outer walls of a building.

BACKGROUND ART

There is a need for an inexpensive, easy to erect, light weight, and reliable tile support arrangement for buildings.

Inclined roofs of, say, domestic buildings commonly incorporate heavy, shaped, baked clay tiles supported on successive rows of timber battens that extend between rafters of the roof. The use of such tiles together with the timber battens exerts considerable weight on the rafters, which must be of a sufficient strength (and size) to sustain the weight over a long term. The use of timber battens and rafters of sufficient load bearing size also places a drain on timber resources.

Known tile support arrangements are disclosed in U.S. Pat. No. 6,052,961 to Gibbs, and U.S. Pat. No. 6,542,596 to Waddington, as well as in Japanese Patent No. 2,248,563 to Sasaki.

However, whilst the aforementioned arrangements use non-timber battens or batten-like structures, they are somewhat complex to assemble and their many large and small component parts make them costly to manufacture and difficult to repair.

It is an object of the present invention to provide a tile support arrangement for supporting flat plate tiles on an inclined roof or against the outer walls of a building that overcomes, or at least substantially ameliorates, the disadvantages of the aforementioned prior art.

It is another object of the present invention to provide a tile support arrangement for inclined roofs that does not employ timber battens and requires rafters of lighter weight than are presently used for clay tile roofs.

It is yet another object of the present invention to provide a tile support arrangement for the outer walls of a building that can be used to provide an aesthetically appealing, tiled wall appearance.

SUMMARY OF THE INVENTION

According to the invention, there is provided a tile support arrangement comprising interlocking panels adapted to support thereon a plurality of tiles, battens which support thereon the interlocking panels, and means for securing the battens to load bearing frame members of an inclined roof or a wall of a building. Each batten includes an upright portion which supports the interlocking panels in spaced relationship to the frame members, and wherein the means for securing the battens to the load bearing frame members comprise a plurality of elongated beams having first longitudinal axes. The beams are secured in end to end relationship upon each load bearing frame member and define a second longitudinal axis. The relationship between the beam and the frame member is such that there is alignment of the first and second longitudinal axes, wherein for each load bearing frame member, a lower portion of a batten is sandwiched between facing surfaces of opposing ends of adjacent elongated beams and is secured to at least one of the opposing ends. The first and second axes, as defined herein, are aligned in a plane and positioned in parallel relation. (See FIG. 2, for example)

Preferably, each interlocking panel is so supported on the battens that it has a first edge adapted to be located, in use, above a second edge in opposed relationship to the first edge. The first edge defining an upwardly hooked portion and the second edge defining a downwardly hooked portion, wherein an upper one of the panels in the arrangement is interlocked to a lower one of the panels by mutual engagement of the upper panel downwardly hooked portion with the lower panel upwardly hooked portion.

It is preferred that each batten is an upright planar panel that is adapted to extend from a first secured location against at least one of the opposing ends of adjacent elongated beams secured upon a first load bearing frame member to a second secured location against at least one of the opposing ends of adjacent elongated beams. The first beam is secured upon a first load bearing frame member and the second beam is secured upon a second load bearing frame member that is spaced apart from the first load bearing frame member.

In a preferred form, the upright planar panel has an upper portion that is secured to the upwardly hooked portion of an interlocking panel.

The lower portion of the upright planar panel is preferably secured by a screw to an end surface of a lower one of adjacent elongated beams, and the upper portion of the upright planar panel is preferably secured by a spot weld to the upwardly hooked portion of an interlocking panel.

The tile support arrangement also includes clips adapted to fix the tiles on the interlocking panels.

Each clip has a first end adapted to be located, in use, above a second end in opposed relationship to the first end. Both the first and second ends define separate upwardly hooked portions, wherein the upwardly hooked portion at the first end is adapted to engage within the downwardly hooked portion of an interlocking panel that supports a tile, and the upwardly hooked portion at the second end is adapted to engage around a lower edge of the tile.

DETAILED DESCRIPTION OF THE INVENTION

Figure 1:
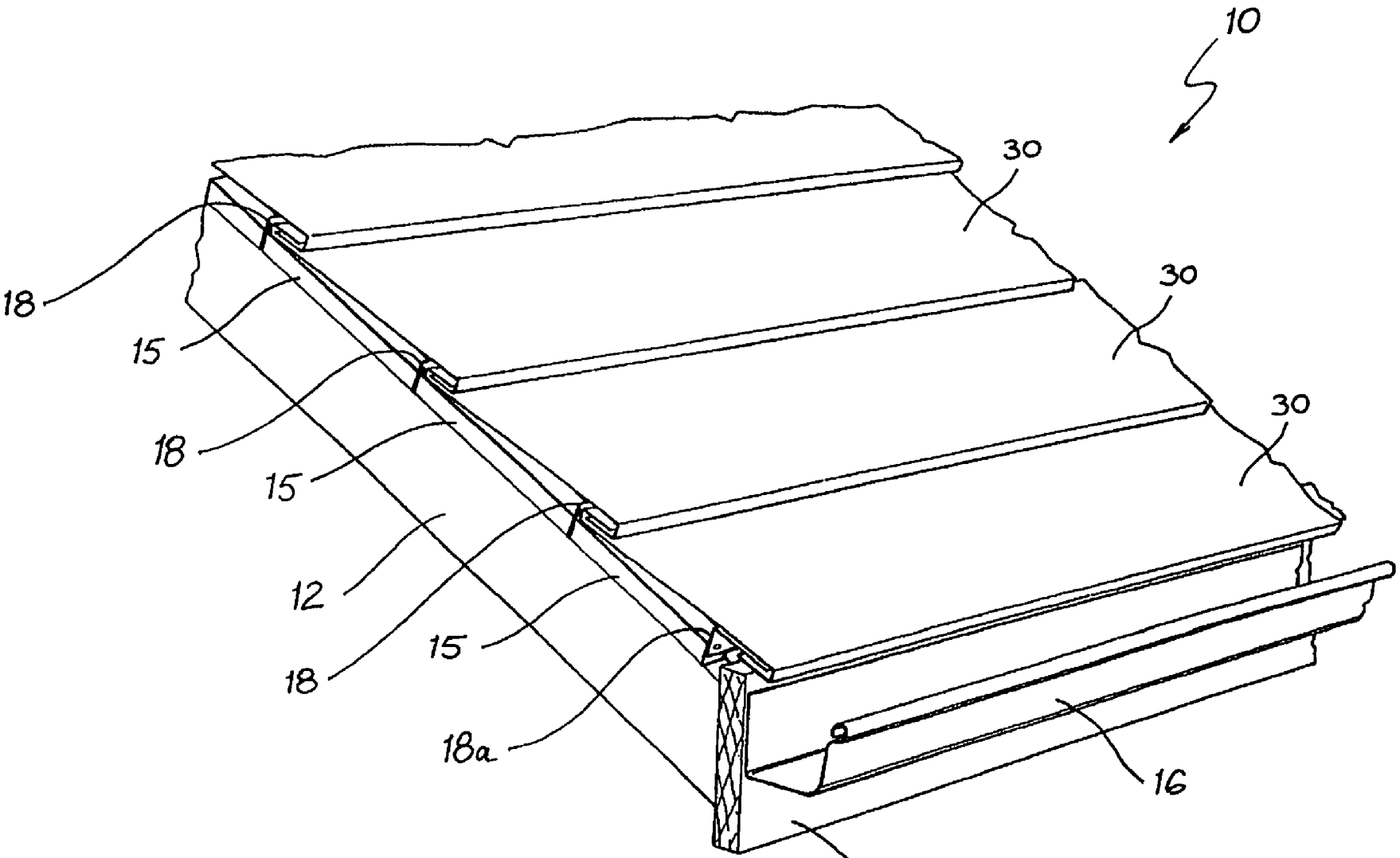
FIG. 1 is a perspective view of a portion of a tile support arrangement, including a batten, according to a preferred embodiment of the present invention, in use on an inclined roof nearest a gutter of the roof.

The tile support arrangement 10 shown in FIGS. 1 to 4 is supported on load bearing timber rafters (only rafter 12 shown) of an inclined roof. As in conventional inclined roofs, there is a fascia board 14 at the lower end of the inclined roof, which is secured to the rafters, and a gutter 16 is secured along the fascia board 14.

A plurality of elongated timber beams 15 are arranged in end to end relationship thereupon and are secured, for example, by nails to each rafter 12. The longitudinal axes of the beams 15 are aligned with the longitudinal axis of the rafter 12.

Figure 5:
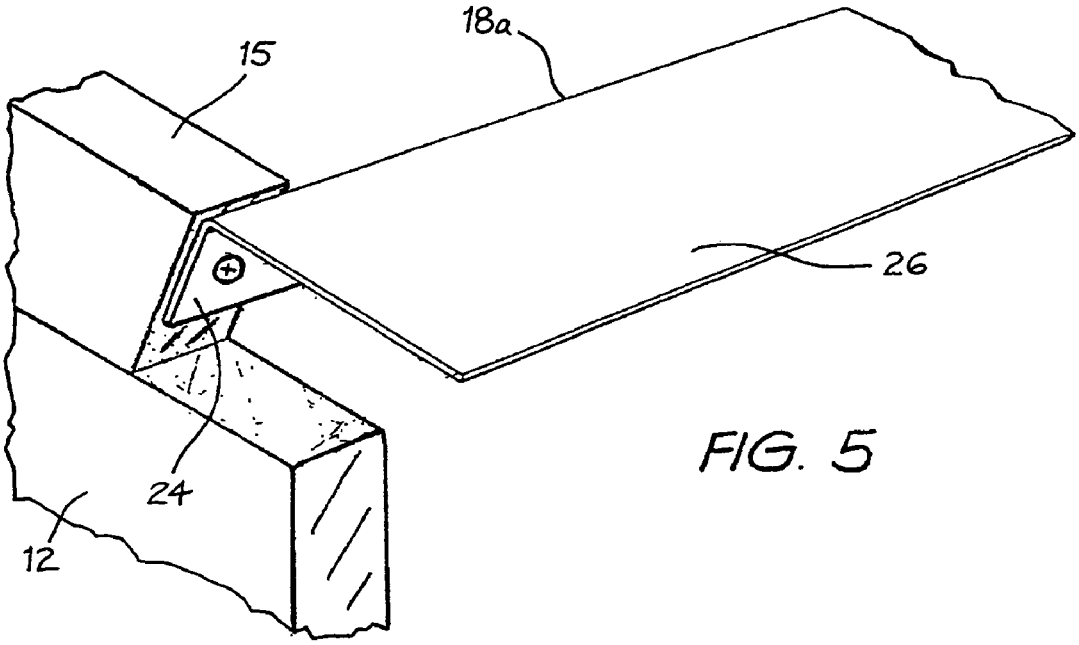
FIG. 5 is a perspective view of the starter batten shown in FIG. 4 secured to an end surface of an elongated beam which is secured to a load bearing timber rafter.
Figure 9:
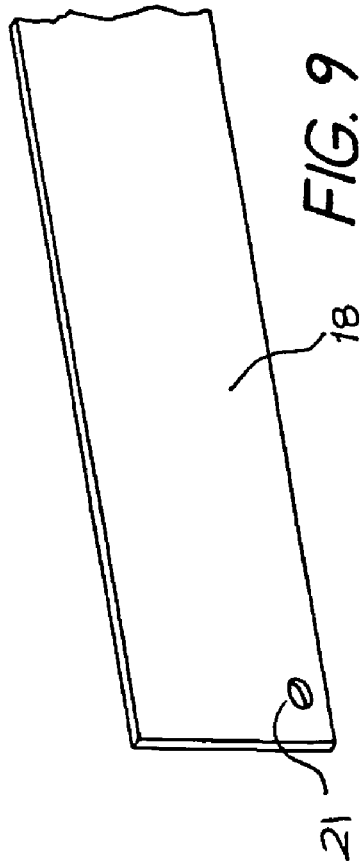
FIG. 9 is a perspective view of a batten, configured and adapted for use with the tile support arrangements shown in FIGS. 1 to 3, 6 and 7.

Supported against the beams 15 is a plurality of spaced apart battens 18 which, as in conventional inclined roofs, extend perpendicularly a distance from one rafter 12 to another. A lower portion of each batten 18 is sandwiched between facing surfaces of opposing ends 17 of adjacent elongated beams 15, and is secured to at least one of the opposing ends 17 by fasteners such as screws 20, for example. Each batten 18 (except for the starter batten 18*a* shown in FIGS. 4 and 5) is of identical shape and size for a given application, and is, in this embodiment, constructed of a planar panel or sheet of galvanised iron (see FIG. 9), but may be constructed of any light weight, resilient and load bearing material.

In use, a first plurality of beams 15 is connected to a plurality of spaced apart rafters 12 of an inclined roof. Each beam 15 is aligned in parallel with the axis defined by each rafter 12. Each batten 18, 18*a* is positioned upright and extends from a first secured location against an end surface 17 of a lower one of adjacent elongated beams 15 secured upon a first load bearing timber rafter 12 to a second secured location against an end surface 17 of a lower one of adjacent elongated beams 15 secured upon a second load bearing timber rafter 12 that is spaced apart from the first load bearing timber rafter 12. The lower portion of each batten 18 is preferably formed that it allows for the passage of the screws 20, such as by having preformed screw holes 21 (see FIG. 9) formed in the lower portion at positions corresponding to, in use, a desired securing location on the end surface 17 of a beam 15. A securing location chosen near the top of the end surface 17 of the beams 15 will allow the height at which the support panels 30, and hence the tiles 32, are supported from the rafters 12 to be optimised. Securing the battens 18 near the bottom of the end surface 17 of the beams 15 will reduce the height at which the support panels 30 and tiles 32 are supported from the rafters 12. It is believed that the higher the support panels 30 and tiles 32 are supported from the rafters 12, the wider the allowable span (distance) between rafters 12 may be without compromising the usefulness or strength of the tile support arrangement 10.

The starter batten 18*a* (see FIGS. 4 and 5) has an upright portion 24 integrally connected to a transversely extending portion 26 projecting, in use, in one downward direction only from the top of the upright portion 24.

Supported on the battens 18 are interlocking panels 30 adapted to support thereon a plurality of tiles 32. Each panel 30 is of identical shape and size and is, in this embodiment, constructed of a single bent sheet of galvanised iron but may be constructed of any resilient, light weight and load bearing material, including an extrudable plastic material. Each panel 30 has opposed, but not identical, first and second edges along its length.

The first edge of the panel 30, which is adapted to be located, in use, above the second edge, defines an upwardly hooked portion 34 formed by an upward and back bending of a first edge region of the panel 30. The second edge of the panel 30 defines a downwardly hooked portion 36 formed by a downward and back bending of a second edge region of the panel 30. The upward and back bending and the downward and back bending of the opposed edge regions of each panel 30 may be the result of conventional metal forming apparatus that can bend sheet metal into a desired shape in a continuous process.

In order to interlock any two adjacent panels 30 down an inclined roof, the downwardly hooked portion 36 of an upper one of the panels 30 in the tile support arrangement 10 is engaged with the upwardly hooked portion 34 of an adjacent, lower one of the panels 30 in the tile support arrangement.

An upper portion of each batten 18 is secured, say, by a spot weld or a fastener 19 such as a threaded connector or rivet, to the upwardly hooked portion 34 of a lower one of the panels 30. In this way, because each pair of adjacent panels 30 are interlocked by mutual engagement of their respective downwardly and upwardly hooked portions, 36, 34, respectively, the upper portion of each batten 18 only needs to be secured to one of the panels, in the manner described above, in order to support the weight of each pair of interlocking adjacent panels above the rafters 12.

Figure 2:
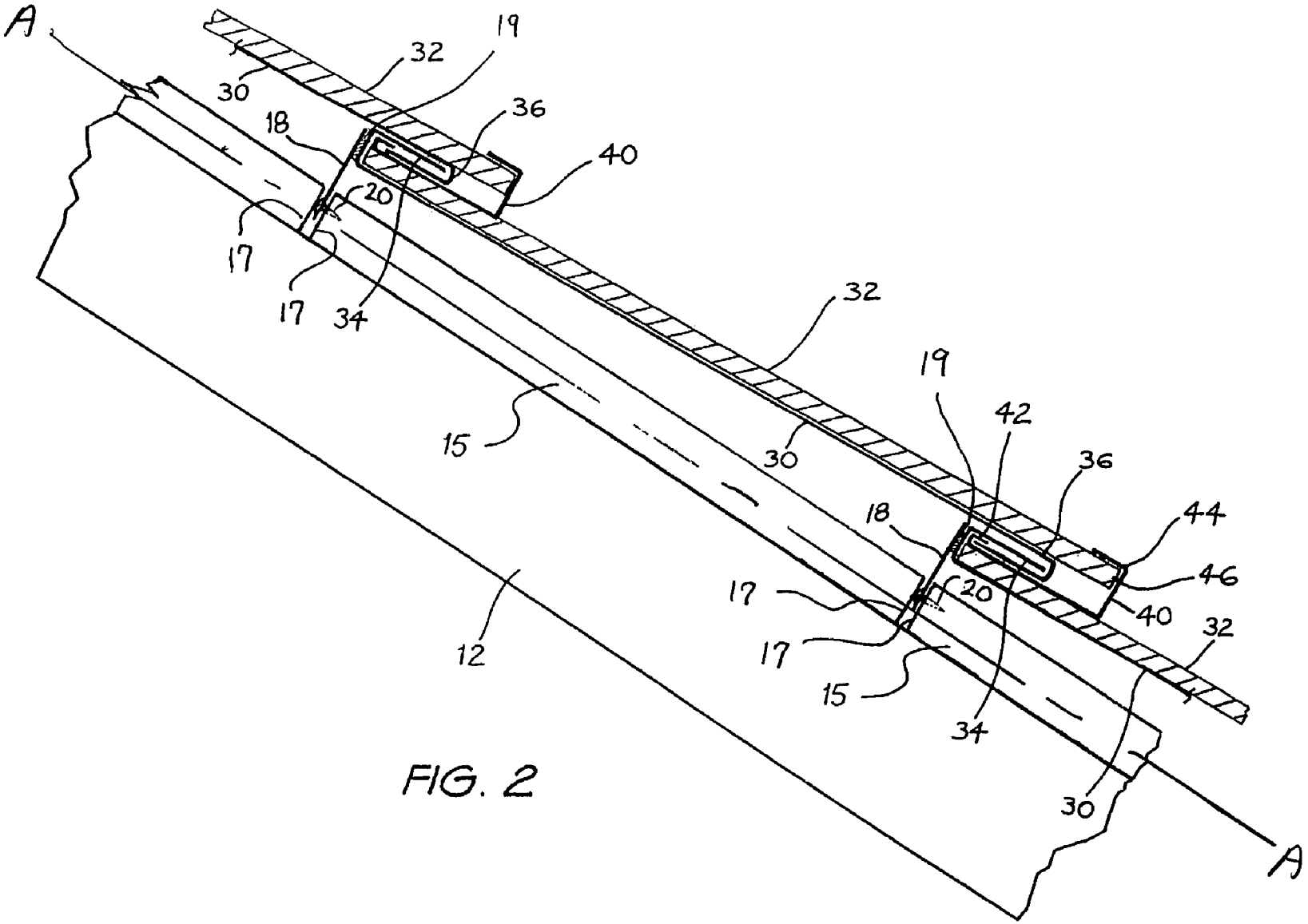
FIG. 2 is a side view, partially in cross-section, of a portion of the tile support arrangement of FIG. 1 shown supporting tiles on an inclined roof.
Figure 8:
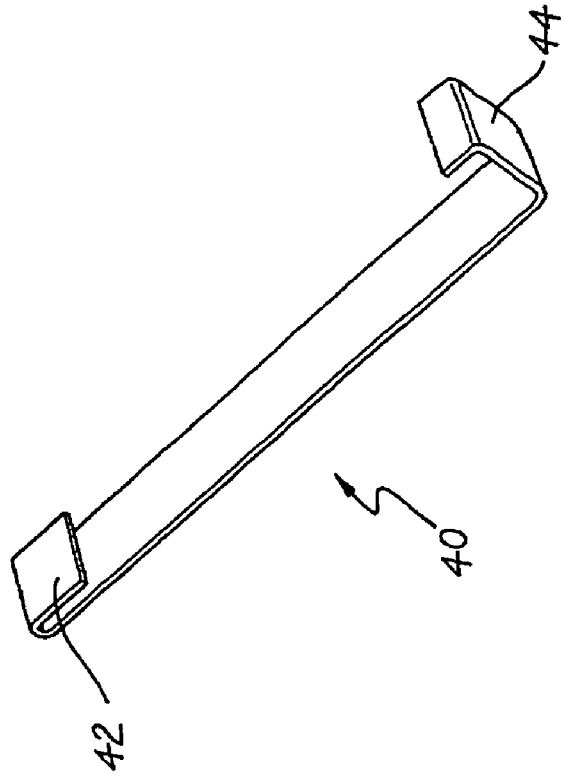
FIG. 8 is a perspective view of a clip, configured and adapted for use with the tile support arrangements of the present invention, shown in FIGS. 1 to 3, 6 and 7.

The tiles 32 supported on the interlocking panels 30 are flat plate tiles of considerably lighter weight than the commonly used heavy, shaped, baked clay tiles. The tiles 32 do not interlock with each other, but are fixed in place on the panels 30 by clips 40, as shown in FIGS. 2 and 8, which prevent them from sliding, under gravity, down the face of the panels 30. Each clip 40 is of identical shape and size and is, in this embodiment, constructed of a single bent strip of galvanised iron, but may be constructed of any resilient, light weight and load bearing material, including an extrudable plastic material. Each clip 40 has opposed, but not identical, first and second ends. The first end of the clip 40 is adapted to be located, in use, above the second end, and both the first and second ends define separate upwardly hooked portions 42, 44 respectively. The upwardly hooked portion 42 at the first end is adapted to engage within the downwardly hooked portion 36 of an interlocking panel 30, and the upwardly hooked portion 44 at the second end is adapted to engage around a lower edge 46 of the tile 32. In this embodiment, two spaced apart clips 40 fix each tile 32 onto its corresponding surface portion of the panel 30.

Figure 3:
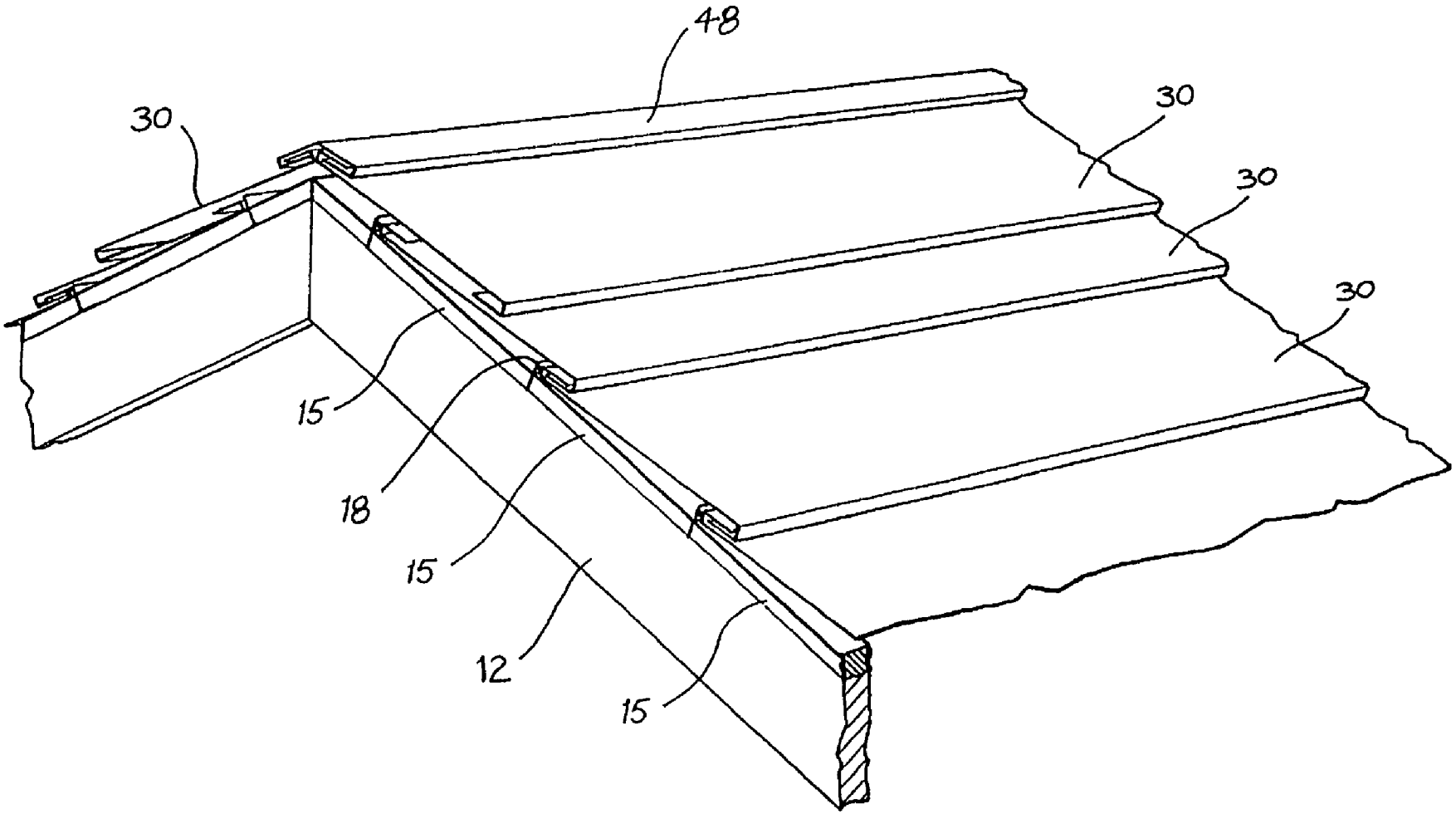
FIG. 3 is a right side perspective view from above, of a portion of the tile support arrangement of FIGS. 1 or 2, in use on an inclined roof nearest a ridge of the roof.
Figure 4:
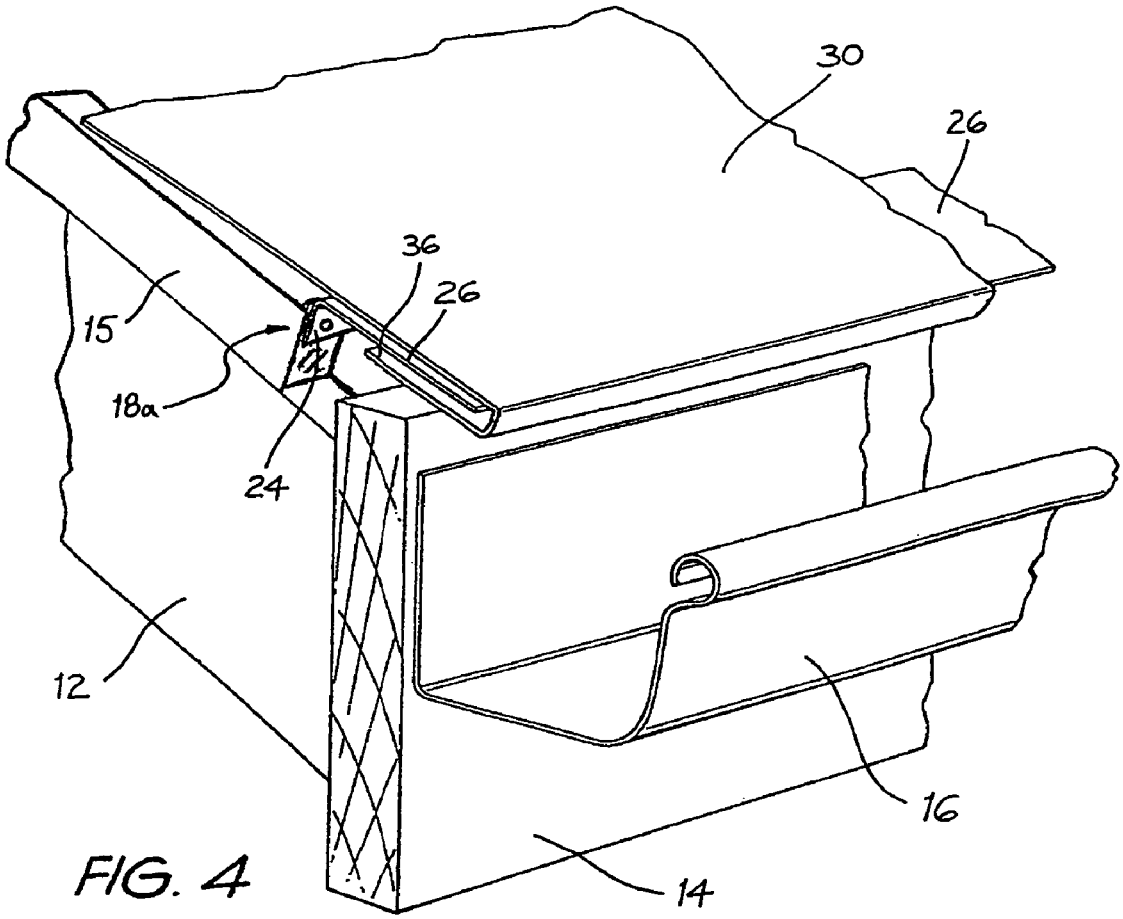
FIG. 4 is a perspective view of a portion of the tile support arrangement of FIG. 1, specifically showing a starter batten which supports a panel nearest the gutter of the roof.

As shown in FIG. 3, the apex or ridge of the inclined roof is capped by an inverted V-shaped member 48 having a downwardly hooked portion at each of its opposed edges along its length. These opposed downwardly hooked portions engage with the upwardly hooked portions 34 of the respective panels 30 located on opposite sides of the inverted V-shaped member 48 on the inclined roof. The member 48 thus prevents rainwater ingress through the gap between the oppositely inclined, uppermost panels 30 of the tile support arrangement on the roof.

Figure 6:
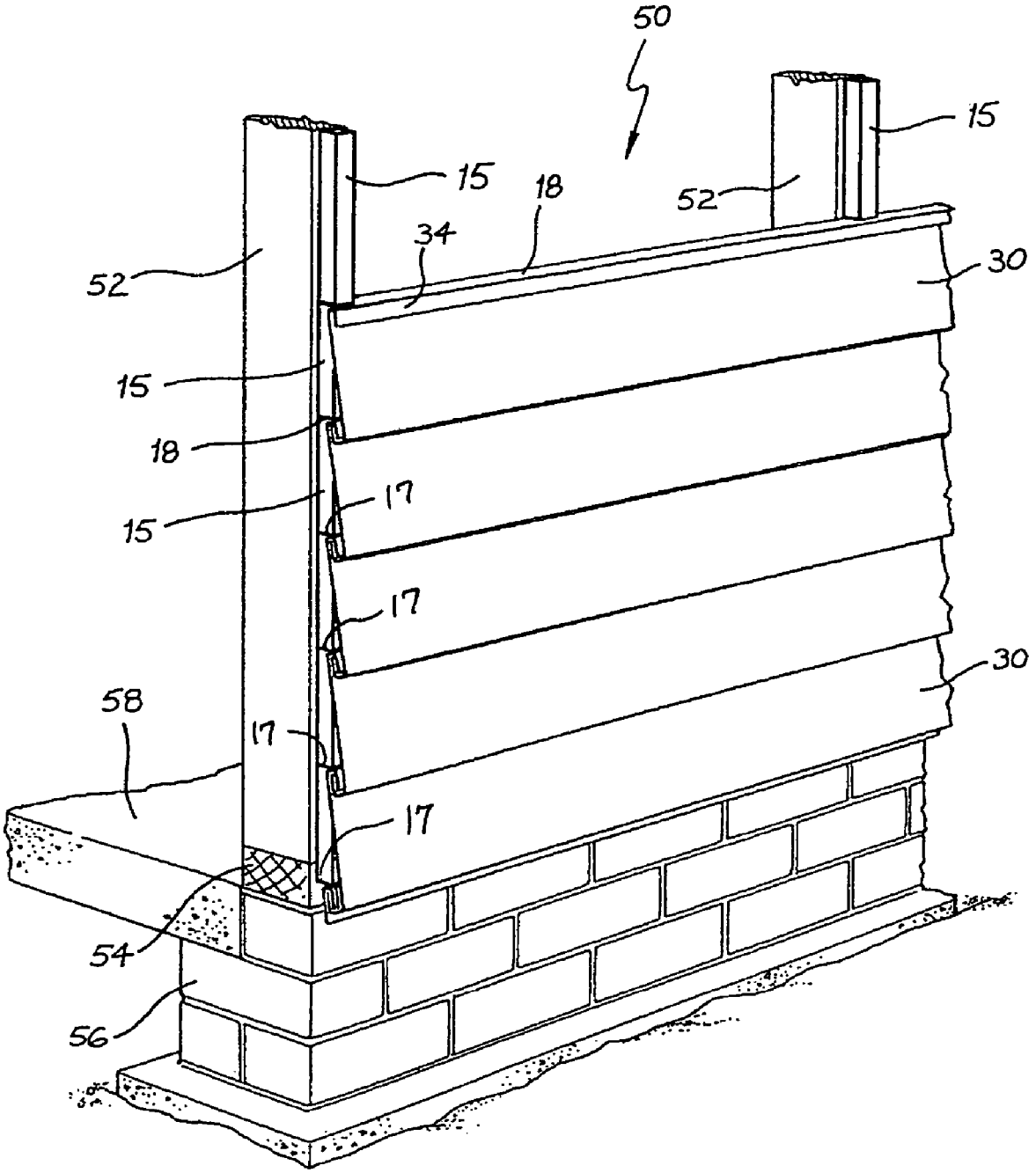
FIG. 6 is a perspective view of a portion of a tile support arrangement according to another preferred embodiment of the present invention, in use against an outer wall of a building.
Figure 7:
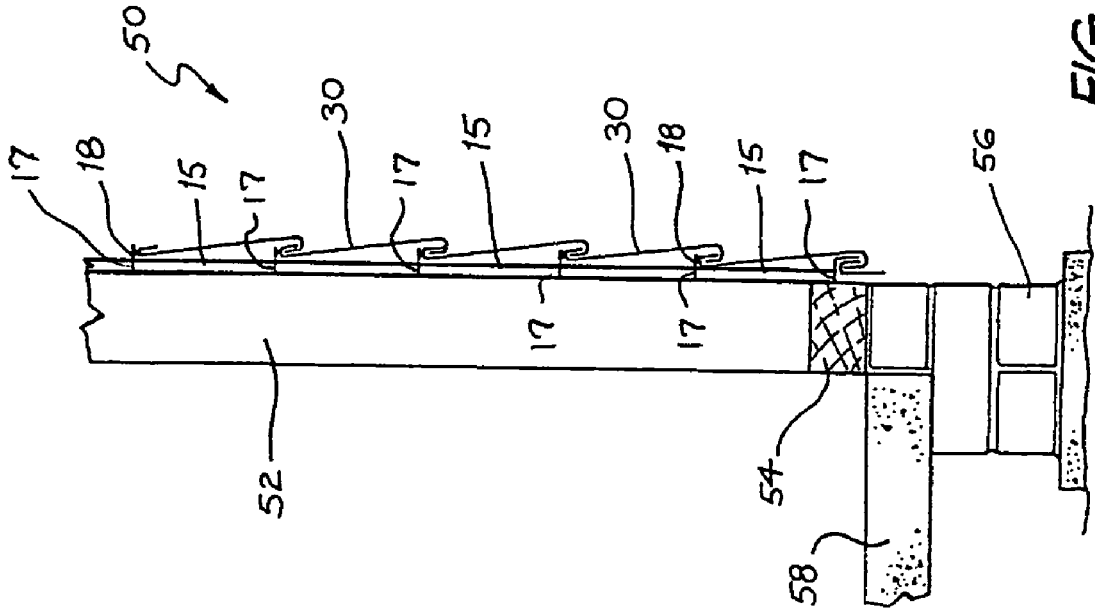
FIG. 7 is a side elevational view of the tile support arrangement of FIG. 6.

The tile support arrangement 50 shown in FIGS. 6 and 7 is supported on load bearing timber studs 52 of a building outer wall. There is a plate board 54, upon which the studs 52 are supported, and the plate board 54 is secured to, in this embodiment, a brickwork foundation 56 supporting a concrete floor 58. Features of the tile support arrangement 50 corresponding to those of the tile support arrangement 10 illustrated in FIGS. 1 to 4 are hereinafter given corresponding reference numerals.

Secured, say, by fasteners such as nails, staples or threaded connectors, to each stud 52 are a plurality of elongated timber beams 15 arranged in end to end relationship thereupon. The longitudinal axes of the beams 15 are aligned with the longitudinal axis of the stud 52.

Supported against the beams 15 are a plurality of spaced apart battens 18. Each batten 18 extends perpendicularly a distance from one stud 52 to another, and a first (inner) portion thereof is sandwiched between facing surfaces of opposing ends 17 of adjacent elongated beams 15, and is secured to the lowermost of the opposing ends 17, say, by screws 20 (see FIG. 2).

In use, each batten 18 is so located on an outer wall that it is horizontal and extends from a first secured location against an end surface 17 of a beam 15 secured upon a first stud 52 to a second secured location against an end surface 17 of a beam 15 secured upon a second stud 52 that is spaced apart from the first stud 52. The (first) inner portion of each batten 18 has preformed screw holes 21 therethrough for allowing the passage of fasteners such as screws into a desired securing location on the end surface 17 of a beam 15.

Supported against the battens 18 are interlocking panels 30 adapted to support thereon a plurality of tiles 32. The manner in which any two adjacent panels 30 are interlocked down an outer wall is identical to that for the inclined roof mentioned earlier. Also, the manner in which the tiles 32 are supported and fixed on the interlocking panels 30 is identical to that for the inclined roof mentioned earlier.

Various modifications may be made in details of design and construction without departing from the scope and ambit of the invention.

I claim:

1. A tile support arrangement comprising interlocking panels adapted to support thereon a plurality of tiles, battens which support thereon the interlocking panels, and means for securing the battens to load bearing frame members of an inclined roof or a wall of a building, wherein each batten includes an upright portion which supports the interlocking panels in spaced relationship to the frame members, and wherein the means for securing the battens to the load bearing frame members comprise a plurality of adjacent elongated beams having first longitudinal axes and which are secured in end to end relationship upon each load bearing frame member having a second longitudinal axis, the relationship being such that there is alignment of the first and second longitudinal axes, wherein for each load bearing frame member, a lower portion of a batten is sandwiched between facing surfaces of opposing ends of said adjacent elongated beams and is oriented generally transverse to said longitudinal axes and secured to at least one of the opposing ends.

2. The tile support arrangement of claim 1 wherein each interlocking panel is so supported on the battens that it has a first edge adapted to be located, in use, above a second edge in opposed relationship to the first edge, the first edge defining an upwardly hooked portion and the second edge defining a downwardly hooked portion, wherein an upper one of the panels in the arrangement is interlocked to a lower one of the panels by mutual engagement of the upper panel downwardly hooked portion with the lower panel upwardly hooked portion.

3. The tile support arrangement of claim 1 wherein each batten is an upright planar panel that is adapted to extend from a first secured location against at least one of the opposing ends of adjacent elongated beams secured upon a first load bearing frame member to a second secured location against at least one of the opposing ends of adjacent elongated beams secured upon a second load bearing frame member that is spaced apart from the first load bearing frame member.

4. The tile support arrangement of claim 3 wherein the upright planar panel has an upper portion that is secured to the upwardly hooked portion of an interlocking panel.

5. The tile support arrangement of claim 1 further including clips adapted to fix the tiles on the interlocking panels.

6. The tile support arrangement of claim 5 wherein each clip has a first end adapted to be located, in use, above a second end in opposed relationship to the first end, both the first and second ends defining separate upwardly hooked portions, wherein the upwardly hooked portion at the first end is adapted to engage within the downwardly hooked portion of an interlocking panel that supports a tile, and the upwardly hooked portion at the second end is adapted to engage around a lower edge of the tile.

7. A tile support arrangement comprising:

a plurality of battens, each said batten having a first end and a second end;

a plurality of beams, each beam aligned with and connected to a load bearing frame member, each beam having opposed ends for receiving a first end of a batten, said first end of said batten being attached to at least one of the ends of the beams;

a plurality of interlocking panels, each panel having a first end having an upwardly hooked portion and an opposed second end having a downwardly hooked portion such that the first and second interlocking panels are mutually engaged by connection of the respective opposed ends, the upwardly hooked portion connected to the second end of the batten such that the plurality of interlocking panels are positioned in fixed spaced relation to the load bearing frame members; and a plurality of tiles placed on the interlocking panels.

8. The tile support arrangement of claim 7 wherein each batten is an upright planar panel that is adapted to extend from a first secured location against at least one of the opposing ends of adjacent elongated beams secured upon a first load bearing frame member to a second secured location against at least one of the opposing ends of adjacent elongated beams secured upon a second load bearing frame member that is spaced apart from the first load bearing frame member.

9. The tile support arrangement of claim 7, wherein said battens are attached to said beams by fasteners which comprise at least one of nails, screws, bolts and staples.

10. The tile support arrangement of claim 7, wherein said battens are attached to said beams by fasteners which are received within apertures in the battens.

11. The tile support arrangement of claim 7, wherein at least one weld connects the battens to the interlocking panels.

12. The tile support arrangement of claim 7, wherein the battens are secured to the ends of the beams on adjacent load bearing frame members, the battens positioned to extend between at least two ends of the beams connected to the load bearing frame members.

13. The tile support arrangement of claim 7, further comprising starter battens.

14. The tile support arrangement of claim 7, further comprising a plurality of clips for fixing the tiles on the interlocking panels.

15. A tile support arrangement comprising:

a plurality of battens, each said batten having an elongate shape and including a first end and a second end;

a plurality of beams, each beam aligned with and connected to a load bearing frame member, each said beam having two opposed ends for receiving a first end of a batten, said first end of said batten being securely connected to at least one of the ends of the beams positioned on adjacent load bearing frame members;

a plurality of interlocking panels, each said panel having a first end having an upwardly hooked portion and an opposed second end having a downwardly hooked portion such that a first interlocking panel and a second interlocking panel is mutually engaged by the connection of the respective upwardly hooked portions and downwardly hooked portions, the upwardly hooked portions being connected to the second end of the batten such that the plurality of interlocking panels are positioned in fixed spaced relation to the load bearing frame members; and a plurality of tiles placed on the panels and fixed in position by clips.

16. The tile support arrangement of claim 15 wherein each batten is an upright planar panel that is adapted to extend from a first secured location against at least one of the opposing ends of adjacent elongated beams secured upon a first load bearing frame member to a second secured location against at least one of the opposing ends of adjacent elongated beams secured upon a second load bearing frame member that is spaced apart from the first load bearing frame member.

17. The tile support arrangement of claim 15 wherein each clip has a first end adapted to be located, in use, above a second end in opposed relationship to the first end, both the first and second ends defining separate upwardly hooked portions, wherein the upwardly hooked portion at the first end is adapted to engage within the downwardly hooked portion of an interlocking panel that supports a tile, and the upwardly hooked portion at the second end is adapted to engage around a lower edge of the tile.

18. The tile support arrangement of claim 15, wherein the second portion of the batten is connected to the upwardly hooked portion of the interlocking panel by one or more welds.

19. The tile support arrangement of claim 15, further comprising starter battens.

* * * * *

UNITED STATES PATENT AND TRADEMARK OFFICE

CERTIFICATE OF CORRECTION

PATENT NO. : 7,591,115 B2
APPLICATION NO. : 11/045723
DATED : September 22, 2009
INVENTOR(S) : Richard J. Morris It is certified that error appears in the above-identified patent and that said Letters Patent is hereby corrected as shown below:

Title Page, insert

Item -- [30], Foreign Application Priority Data.

Aug. 22, 2001 (AU) .....63627/01 --

Signed and Sealed this

Twelfth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,591,115 B2
APPLICATION NO. : 11/045723
DATED : September 22, 2009
INVENTOR(S) : Richard J. Morris It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1044 days.

Signed and Sealed this

Twenty-first Day of September, 2010

David J. Kappos

David J. Kappos
*Director of the United States Patent and Trademark Office*